US009605932B2

(12) United States Patent
Dunaway et al.

(10) Patent No.: US 9,605,932 B2
(45) Date of Patent: Mar. 28, 2017

(54) GAS GENERATORS, LAUNCH TUBES INCLUDING GAS GENERATORS AND RELATED SYSTEMS AND METHODS

(71) Applicant: Orbital ATK, Inc., Dulles, VA (US)

(72) Inventors: James D. Dunaway, Brigham City, UT (US); Duane J. Garbe, Mendon, UT (US); William P. Sampson, North Ogden, UT (US); Robert L. Hatch, Wellsville, UT (US)

(73) Assignee: Orbital ATK, Inc., Plymouth, MN (US)

( * ) Notice: Subject to any disclaimer, the term of this patent is extended or adjusted under 35 U.S.C. 154(b) by 0 days.

(21) Appl. No.: 14/606,601

(22) Filed: Jan. 27, 2015

(65) Prior Publication Data

US 2016/0161226 A1 Jun. 9, 2016

Related U.S. Application Data

(62) Division of application No. 13/690,040, filed on Nov. 30, 2012, now Pat. No. 8,967,046.

(51) Int. Cl.

| | |
|---|---|
| ***F41A 1/04*** | (2006.01) |
| ***F42B 3/04*** | (2006.01) |
| ***F41F 3/04*** | (2006.01) |

(52) U.S. Cl.

CPC ..... *F42B 3/04* (2013.01); *F41A 1/04* (2013.01); *F41F 3/04* (2013.01)

(58) Field of Classification Search

CPC .. F41F 3/04; F41A 19/58; F41A 19/59; F41A 19/60; F41A 19/69; F41A 19/70

USPC ..... 89/1.813, 1.814

See application file for complete search history.

(56) References Cited

U.S. PATENT DOCUMENTS

| | | | | |
|---|---|---|---|---|
| 2,966,827 | A | 1/1961 | Harvey | |
| 3,550,501 | A | 12/1970 | Munger et al. | |
| 3,611,941 | A | 10/1971 | Hopmeier | |
| 3,713,391 | A | 1/1973 | Stout, Jr. et al. | |
| 3,745,876 | A | 7/1973 | Rocha | |
| 3,946,638 | A | 3/1976 | Cobb | |
| 4,136,894 | A * | 1/1979 | Ono | B60R 21/26 102/443 |
| 4,278,026 | A * | 7/1981 | Hibbs | F42C 15/31 102/202 |
| 4,296,084 | A * | 10/1981 | Adams | B60R 21/2644 422/166 |
| 4,346,658 | A * | 8/1982 | Hibbs | F42C 15/40 102/254 |
| 4,523,538 | A | 6/1985 | Hollmann et al. | |
| 4,671,163 | A | 6/1987 | Erikson | |
| 4,716,830 | A | 1/1988 | Davis et al. | |
| 5,481,977 | A | 1/1996 | Evans et al. | |

(Continued)

FOREIGN PATENT DOCUMENTS

WO 9635916 A1 11/1996

OTHER PUBLICATIONS

Switchblade, Features and Specifications, www.avinc.com/switchblade, vol. 1 (2012) 1 page.

*Primary Examiner* — Stephen M Johnson

(74) *Attorney, Agent, or Firm* — TraskBritt

(57) ABSTRACT

Gas generators may be utilized for launching a projectile. Launch tubes may include gas generators. Methods of launching a projectile may include utilizing gas generators to impart an initial velocity to a projectile.

16 Claims, 5 Drawing Sheets

(56) References Cited

U.S. PATENT DOCUMENTS 5,564,741 A * 10/1996 Ward ..... B60R 21/2644 280/740
5,631,441 A 5/1997 Briere et al.
5,668,341 A 9/1997 Reynolds et al.
5,803,494 A * 9/1998 Headley ..... B60R 21/264 280/736
5,819,526 A 10/1998 Jackson et al.
5,837,919 A 11/1998 Yagla et al.
5,847,307 A 12/1998 Kennedy et al.
5,942,712 A 8/1999 Mello
6,044,746 A * 4/2000 Gendre ..... F42B 5/02 89/1.703
6,079,310 A 6/2000 Yagla et al.
6,119,454 A 9/2000 Valisko
6,230,629 B1 5/2001 Doctor et al.
6,260,797 B1 7/2001 Palmer
6,418,870 B1 7/2002 Lanowy et al.
6,644,206 B2 11/2003 Fogle, Jr.
7,013,788 B1 3/2006 Williams et al.
7,182,014 B2 2/2007 Smith
7,313,881 B1 1/2008 Gieseke et al.
8,294,287 B2 10/2012 Oleynik et al.
2003/0034641 A1 2/2003 Zimbrich et al.
2003/0160437 A1* 8/2003 Ohji ..... B60R 21/2644 280/736
2008/0148927 A1* 6/2008 Alberding ..... F41B 11/00 89/1.817
2009/0308274 A1 12/2009 Schroeder et al.
2011/0162247 A1* 7/2011 Hammer ..... F41A 1/08 42/105
2011/0221175 A1 9/2011 Kobayashi et al.
2012/0180361 A1* 7/2012 Scarr ..... F42B 5/03 42/76.01
2012/0291654 A1* 11/2012 Wilson ..... F42B 12/32 102/492
2014/0150683 A1 6/2014 Dunaway et al.

* cited by examiner

GAS GENERATORS, LAUNCH TUBES INCLUDING GAS GENERATORS AND RELATED SYSTEMS AND METHODS

CROSS-REFERENCE TO RELATED APPLICATION

This application is a divisional of U.S. patent application Ser. No. 13/690,040, filed Nov. 30, 2012, now U.S. Pat. No. 8,967,046, issued Mar. 3, 2015, the disclosure of which is hereby incorporated herein in its entirety by this reference.

TECHNICAL FIELD

The current disclosure relates generally to gas generators. In particular, the current disclosure generally relates to gas generators for use in launch tubes to launch projectiles, launch tubes including such gas generators, projectile systems include such launch tubes, and related methods.

BACKGROUND

Projectiles, such as missiles, rockets, and the like, are launched from various types of launch tubes (e.g., canisters, guns, one or more cells of a vertical launching system (VLS), torpedo tubes, etc.). In some projectile systems, thrust from an integrated projectile motor or propellant carried by the projectile is used to launch the projectile from the launch tube. However, using the thrust generated internally by the projectile thrust to launch the projectile (i.e., a hot launch), reduces the amount of fuel for the motor or propellant available to propel the projectile to an intended target after the projectile leaves the launch tube.

In response to this problem, some projectile systems employ a launching propellant, which is separate from the projectile's propellant, to launch the projectile from the launch tube and to provide an initial velocity to the projectile (i.e., a cold launch). For example, projectile systems may include a projectile disposed in a launch tube with a launching propellant and a pusher plate, which may also be characterized as a ram plate, positioned at the aft end of the projectile in the launch tube. When the projectile is to be launched from launch tube, a propellant igniter is activated to ignite the propellant. Expanding gases generated by the burning propellant push the plate and the projectile out through the open end of the launch tube. The thrust source (e.g., a motor and/or propellant) may then be initiated to further accelerate the projectile and propel it to its intended target.

In many applications, it is desirable to minimize the size and cost of the overall projectile system including the projectile, launch tube, and launching propellant. However, the selection, volume and configuration of the launching propellant deployed within a launch tube may require reinforcing the launch tube, pusher plate (where implemented), and projectile as gas pressure and heat from the burning propellant may damage these components, thereby causing launch failure or decreasing the likelihood that components of the projectile system may be reused. Unfortunately, such reinforcements of the components of the projectile system may increase the cost, size, and overall weight of the projectile system. Further, in order to propel the projectile at a selected rate of acceleration and velocity, the selection, volume and configuration of the launching propellant (e.g., the use of multiple initiators and gas generants) may require excessive space in the launch tube, add to the overall size, weight, and cost of the launch tube, and may require the use of complex initiation systems and relatively expensive gas generants.

BRIEF SUMMARY

In some embodiments, the present disclosure includes a gas generator for use in launching a projectile. The gas generator includes a housing having a longitudinal axis and configured to be positioned within a launch tube for a projectile. The housing includes a first plenum and a second plenum adjacent to the first plenum. A first plurality of apertures in the housing extends from the first plenum to the second plenum in a direction transverse to the longitudinal axis of the housing. A second plurality of apertures in the housing extend from the second plenum to an exterior portion of the housing in a direction along the longitudinal axis of the housing. The gas generator further includes at least one propellant positioned within the first plenum and an initiator for igniting the at least one propellant. The initiator is positioned proximate to the at least one propellant.

In additional embodiments, the present disclosure includes a launch tube. The launch tube includes a tube for receiving at least one projectile and a gas generator for launching the at least one projectile from the tube. The gas generator includes an outer housing having a longitudinal axis where the outer housing is sized and configured to be positioned within a launch tube for a projectile. The gas generator further includes at least one propellant positioned within a first plenum in a central portion of the gas generator and an initiator for igniting the at least one propellant, the initiator positioned proximate to the at least one propellant. The gas generator further includes an inner housing disposed at least partially within the outer housing. The inner housing and the outer housing encompass a second plenum substantially surrounding the at least one propellant, and the inner housing comprises a plurality of apertures extending from the first plenum to the second plenum. An exit portion of the gas generator comprises a plurality of apertures extending from the second plenum to an exterior portion of the gas generator.

In yet additional embodiments, the present disclosure includes a method of launching a projectile. The method includes igniting a propellant with an initiator disposed in a first plenum of a housing of a gas generator, combusting at least a portion of the propellant to form a gas, flowing the gas through a first plurality of apertures formed in the housing of the gas generator surrounding the first plenum in a first direction to a second plenum, and flowing the gas through a second plurality of apertures formed in the housing in a second direction to form a plurality of propulsive jets exiting the housing to impart an initial velocity to the projectile.

BRIEF DESCRIPTION OF THE SEVERAL VIEWS OF THE DRAWINGS

While the specification concludes with claims particularly pointing out and distinctly claiming that which is regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular material, device, apparatus, system, or method, but are merely idealized representations that are employed to describe embodiments of the present disclosure. Additionally, elements common between figures may retain the same numerical designation for convenience and clarity.

Figure 1:
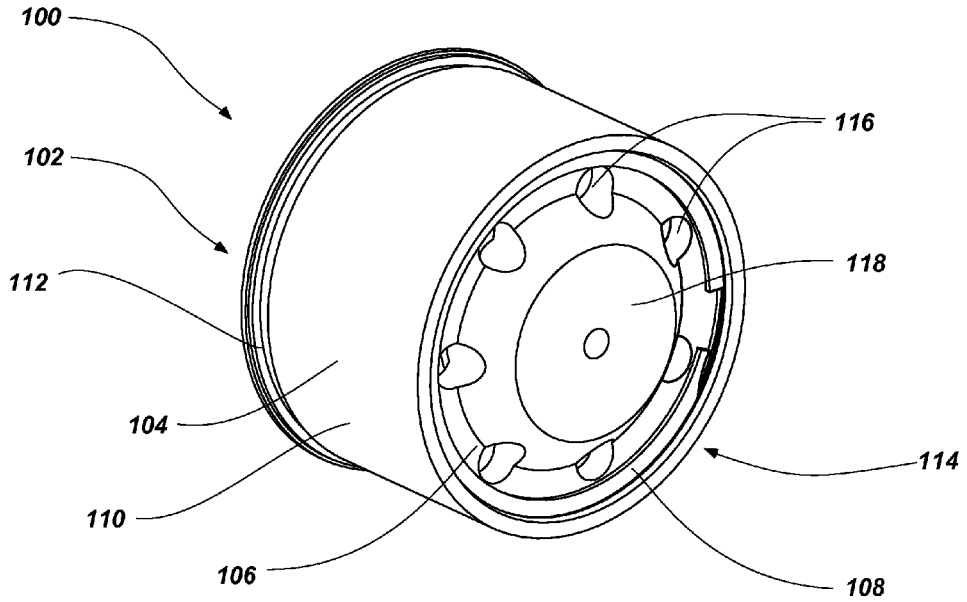
FIG. 1 is a perspective view of a gas generator in accordance with an embodiment of the present disclosure.
Figure 2:
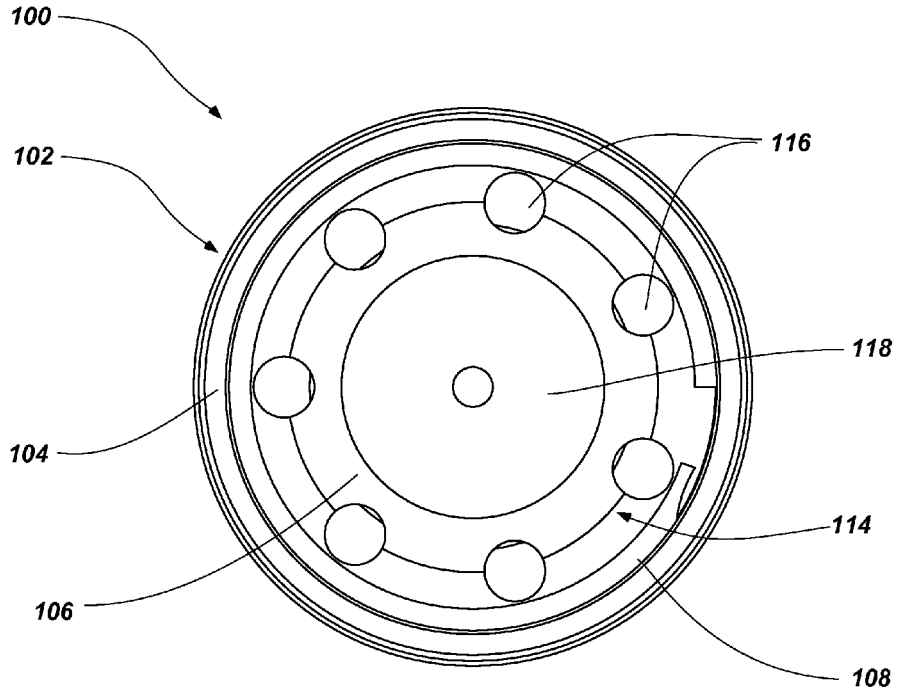
FIG. 2 is a side view of the gas generator shown in FIG. 1.
Figure 3:
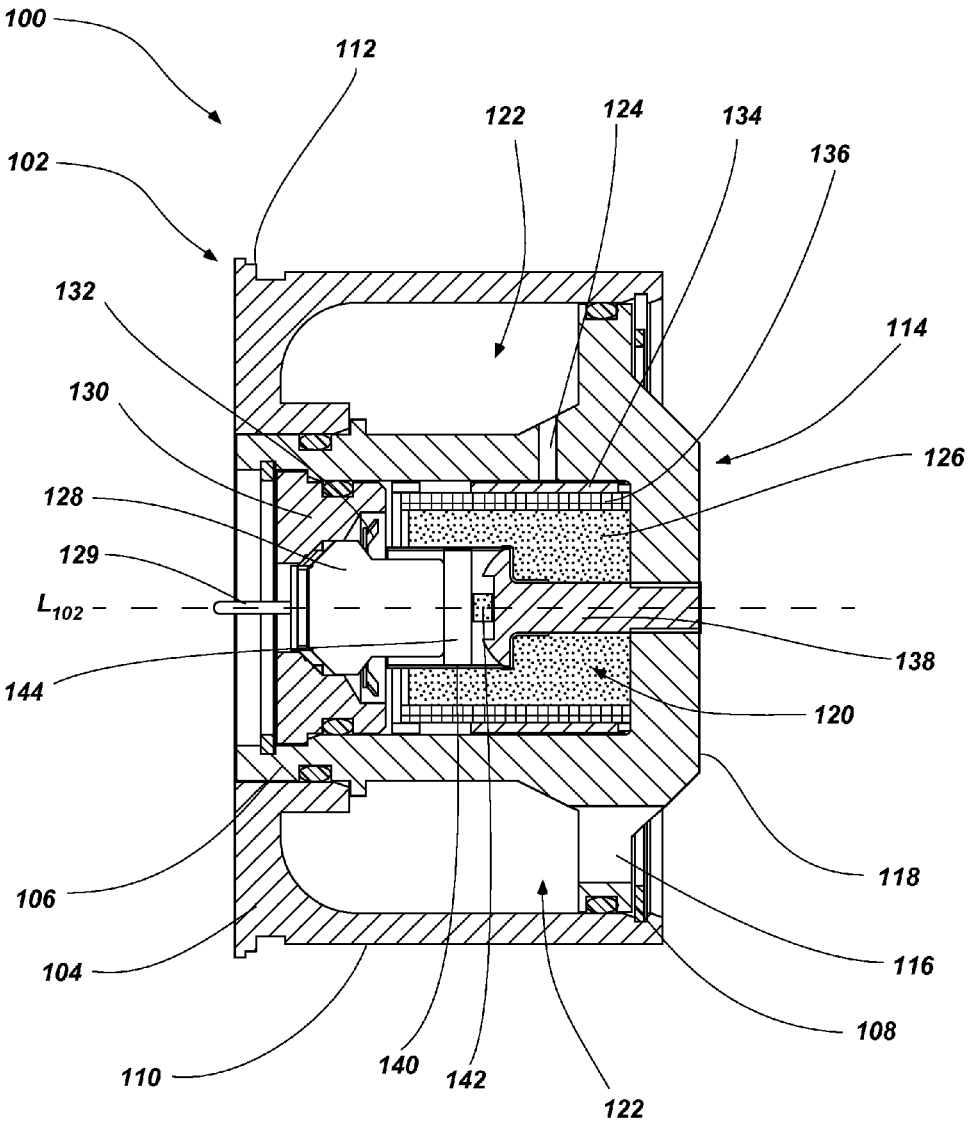
FIG. 3 is a partial cross-sectional view of the gas generator shown in FIG. 1.

FIG. 1 is a perspective view of a gas generator 100 for use in launching a projectile, and FIG. 2 is a side view of the gas generator 100. As shown in FIGS. 1 and 2, the gas generator 100 includes a housing 102 (e.g., formed from structural material such as a metal, a metal alloy (e.g., aluminum), a composite material (e.g., a carbon fiber composite), or combinations thereof) having a longitudinal axis $L_{102}$ (e.g., centerline), as shown in FIG. 3. In some embodiments, the housing 102 may comprise an outer housing 104 and an inner housing 106 that is at least partially received within the outer housing 104. The inner housing 106 may be retained in the outer housing 104 with a snap ring 108. As depicted, the housing 102 is configured to have a substantially cylindrical transverse cross-sectional shape including a cylindrical outer surface 110 in order to fit within a launch tube. Of course, the invention is not so limited, and other shapes for gas generators and associated launch tubes are contemplated and encompassed by the disclosure. For example, and as discussed below in greater detail with reference to FIGS. 7 and 8, the housing 102 may be configured to fit within a launch tube having a complementary cylindrical shape (e.g., a hollow inner tube). The housing 102 may further include a retaining feature 112 to secure the gas generator 100 within the launch tube and to seal against the inner wall of the launch tube to at least partially prevent gases formed by the gas generator 100 from traveling around the gas generator 100 to a back portion of the housing 102.

The gas generator 100 includes an exit portion 114 for directing propellant from the housing 102 of the gas generator 100. For example, the exit portion 114 comprises a side of the gas generator 100 (e.g., one face of the cylindrical housing 102) through which gases generated by combustion of propellant within the gas generator 100 are directed outwardly from the gas generator 100. As depicted, the exit portion 114 includes a portion of the housing 102 (e.g., the inner housing 106) having one or more apertures 116 formed in the housing 102 for directing gases from the interior of the housing 102 to the environment exterior of gas generator 100 and within the launch tube containing gas generator 100. In some embodiments, apertures 116 may be formed in a ring-like structure on a side of the housing 102 (e.g., extending around protrusion 118). As depicted in FIGS. 1 and 2, the housing 102 includes seven apertures; however, in other embodiments, the housing 102 may include any suitable number of apertures 116 and of a size as necessary to achieve a selected amount of thrust for a selected application.

FIG. 3 is a partial cross-sectional view of the gas generator 100 shown in FIG. 1. As shown in FIG. 3, the housing 102 comprises the inner housing 106 partially received within the outer housing 104. The housing 102 includes one or more chambers (e.g., plenums) within the housing 102. For example, a first plenum 120 is located within a portion of the housing 102 (e.g., by the inner housing 106). A second plenum 122, which is in communication with the first plenum 120, is located within another portion of the housing 102. For example, a portion of the inner housing 106 and a portion of the outer housing 104 may cooperatively form the second plenum 122. As depicted, interfaces between the inner housing 106 and the outer housing 104 may include one or more O-rings to at least partially seal between components of the housing 102 and to minimize any gas leakage that may occur at the interfaces of the outer housing 104 and the inner housing 106.

The second plenum 122 may reside within the housing 102 in substantially surrounding relationship to the first plenum 120. For example, the second plenum 122 may encircle (e.g., substantially encompass) the first plenum 120 and comprise a substantially annular shape. In other words, the second plenum 122 may radially and circumferentially surround the first plenum 120. The first plenum 120 and the second plenum 122 may be in communication through one or more apertures 124 formed in the housing 102 (e.g., in the inner housing 106) extending between the first plenum 120 and the second plenum 122. In some embodiments, multiple apertures 124 (e.g., two or more) may extend from an outer circumference of the first plenum 120 to enable communication (e.g., fluid communication) between the first plenum 120 and the second plenum 122. For example, the inner housing 120 may include a cylindrical middle portion laterally encompassing the first plenum 120 and having apertures 124 formed around a circumference of and extending through the cylindrical middle portion. The apertures 124 may extend laterally through the housing 102 from the first plenum 120 to the second plenum 122 in a direction transverse (e.g., perpendicular) to the longitudinal axis $L_{102}$. For example, the apertures 124 may extend outwardly along a radius of the inner housing 106 (i.e., radially outward) through the inner housing 106 from the first plenum 120 to the second plenum 122.

The apertures 124 may be sized and configured to control the rate that gases, which are produced in the first plenum 120 by initiation of propellant 126, pass through the apertures 124 to the second plenum 122. For example, the apertures 124 (e.g., seven apertures 124) may be formed to each have a diameter of less than 0.1 inch (2.54 millimeters), less than 0.05 inch (1.27 millimeters), or even less to control the rate of propellant gases passing from the first plenum 120 to the second plenum 122.

As above, the inner housing 106 may include apertures 116 in the inner housing 106 at the exit portion 114 of the gas generator for directing gases from the second plenum 122 to the exterior environment surrounding the gas generator 100. The apertures 116 may extend through a ring-like structure, which may be characterized as a flange, around protrusion 118 of the inner housing 106. The apertures 116 may extend in a direction along the longitudinal axis $L_{102}$ of the housing 102 to direct the gases from the housing 102 to the exterior of the housing 102. For example, the apertures 116 may extend along the longitudinal axis $L_{102}$ (e.g., substantially parallel to the longitudinal axis $L_{102}$) through the housing 102 to direct the propellant gases from the housing 102. As used herein, the term "substantially parallel" means and includes a laterally outward angular orientation of about 45° or less to the longitudinal axis $L_{102}$ of the housing 102.

As discussed above with regard to apertures 124, the number and size (e.g., diameter) of the apertures 116 may be selected control the rate that the propellant gases, which are supplied from the first plenum 120 to the second plenum 122, are released from the housing 102 of the gas generator 100 (e.g., to achieve a selected amount of thrust for a selected application). For example, the apertures 116 (e.g., seven apertures 116) may be formed to each have a diameter of greater than 0.1 inch (2.54 millimeters), greater than 0.25 inch (6.34 millimeters), or even greater to control the rate of propellant gases passing from the second plenum 122 to the exterior of the housing 102 of the gas generator 100. By way of further example, the diameter of the apertures 116 may be selected to be greater than the diameter of the apertures 124 such that the pressure of the gases in the second plenum 122 is less than the pressure of the gases in the first plenum 120. In other words, the relatively larger diameter of apertures 116 provides less constriction of the flow of the gases therethough than the relatively smaller diameter of apertures 124. Such a configuration may enable the second plenum to act as an expansion chamber as the gases from the first plenum 120 enter the second plenum 122 via the apertures 124.

Referring still to FIG. 3, the gas generator 100 includes propellant 126 (e.g., one or more propellants) and an initiator 128 for igniting the propellant 126. For example, the propellant 126 may be positioned within the first plenum 120 proximate a central portion of the gas generator 100. The propellant 126 may be selected from any suitable explosive or reactive material (e.g., a low-order explosive such as nitrocellulose) capable of producing a fluid under pressure (e.g., gas) that may be directed from the housing 102 to produce a propulsive jet. The initiator 128 may be selected from a wide variety of initiation devices suitable for initiating an exothermic reaction of the propellant 126. For example, the initiator 128 may include an initiation or detonation device such as, for example, an exploding foil initiator (EFI), a low energy exploding foil initiator (LEEFI), blasting cap, exploding-bridgewire detonator (EBW), or combinations thereof.

In some embodiments, the protrusion 118 of the inner housing 106 may extend past the outer housing 104 to maximize the volume of the first plenum 120 within the housing 102 of the gas generator 100.

As depicted in FIG. 3, the initiator 128 and propellant 126 may be positioned and secured (e.g., by initiator holder 130) within the first plenum 120, which is formed within the inner housing 106. For example, the inner housing 106 may be configured to form (e.g., entirely form) the first plenum 120 such that the first plenum 120 is positioned at the central portion of the housing 102 of the gas generator 100 (e.g., the first plenum 120 has a centerline that is coincident with a centerline of the housing 102). As discussed above, the outer housing 104 may surround the inner housing 106 and the first plenum 120, and the outer housing 104 and inner housing 106 may define the second plenum 122 therebetween. The initiator holder 130 may be positioned and secured within the first plenum 120 within the inner housing 106 (e.g., with one or more O-rings and the snap ring 108 or crimp mechanisms). In some embodiments, the initiator holder 130 may seal (e.g., hermetically seal) at least a portion of the initiator 128 and the propellant 126 within the first plenum 120. For example, the initiator holder 130 and a portion of the initiator 128 itself may act to seal an inner portion of the initiator 128 and the propellant 126 within the first plenum 120. In some embodiments, the initiator 128 may be secured to the initiator holder 130 with a retainer 132 (e.g., a retainer ring or crimp mechanism).

In some embodiments, the initiator 128 may include a connection feature (e.g., a pin connector 129) to connect the initiator to a control system capable of initiating (e.g., by supplying an electrical signal) the initiator 128, for example, during the launch cycle of a projectile.

In some embodiments, in order to initially seal the propellant 126 (e.g., before initiation of the propellant 126) in the first plenum 120, the propellant may be at least partially surrounded by burst foil 134. For example, burst foil 134 may be positioned circumferentially around the propellant 126 such that the burst foil 134 is positioned between the propellant 124 and each of the apertures 124 leading to the second plenum 122 to at least partially seal the propellant 126 in the first plenum 120.

In some embodiments, the gas generator 100 may include one or more screens 136 positioned around the propellant 126. The screens 136 may reduce (e.g., minimize or substantially inhibit) the amount of solid propellant 126 (e.g., grains of propellant 126) from traveling from the first plenum 120 to the second plenum 122 through the apertures 124. In other words, the screens 136 may act to enable gases produced by the propellant 126 to pass through the screen 136 and to substantially filter (e.g., inhibit) solid grains and combustion products of the propellant 126 from passing through the screen 136 reducing the probability that solid grains or combustion products of the propellant 126 may become lodged within the apertures 124.

In some embodiments, the gas generator 100 may include a shock attenuation feature. For example, the gas generator 100 may include a feature configured to at least partially reduce the amount of force (e.g., shockwave) applied to the propellant 126 by initiation of the initiator 128, such as an exploding-bridgewire detonator). As depicted in FIG. 3, the shock attenuation feature may include a shield 138 (e.g., the head of a screw or bolt that is coupled to the inner housing 106) that is positioned between the initiator 128 and at least a portion of the propellant 126. The shield 138 may act to isolate the propellant 126 from at least a portion (e.g., a majority) of the shockwave produced by the initiator 128, which may reduce the likelihood of any cracking or fracture in the solid propellant 126 from the force of the shockwave. The shock attenuation feature may further include a sleeve 140 that surrounds at least a portion of the shield 138 and a portion of the initiator 128 in order to direct the shockwave produced by the initiation of the initiator 128, for example, toward the shield 138.

In some embodiments, the gas generator 100 may include an explosive booster 142 that creates a bridge between the initiator 128 and the propellant 126 to increase the ability of the initiator 128 to successfully ignite the propellant 126. The explosive booster 142 may comprise an explosive, pyrotechnic, or reactive material, such as, for example, boron potassium nitrate ($BKNO_3$), cyclotrimethylenetrinitramine (RDX), pentaerythritol tetranitrate (PETN), or combinations thereof. As depicted, the gas generator 100 may further include a positioning element 144 (e.g., a foam disk) for retaining the explosive booster 142 between the initiator 128 and the shield 138.

Figure 4:
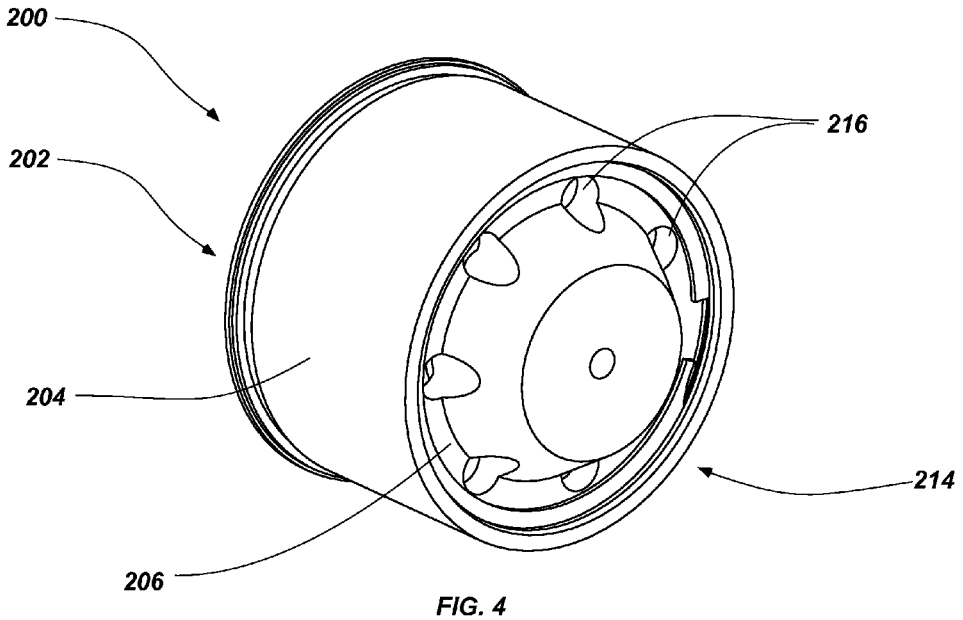
FIG. 4 is a perspective view of a gas generator in accordance with another embodiment of the present disclosure.
Figure 5:
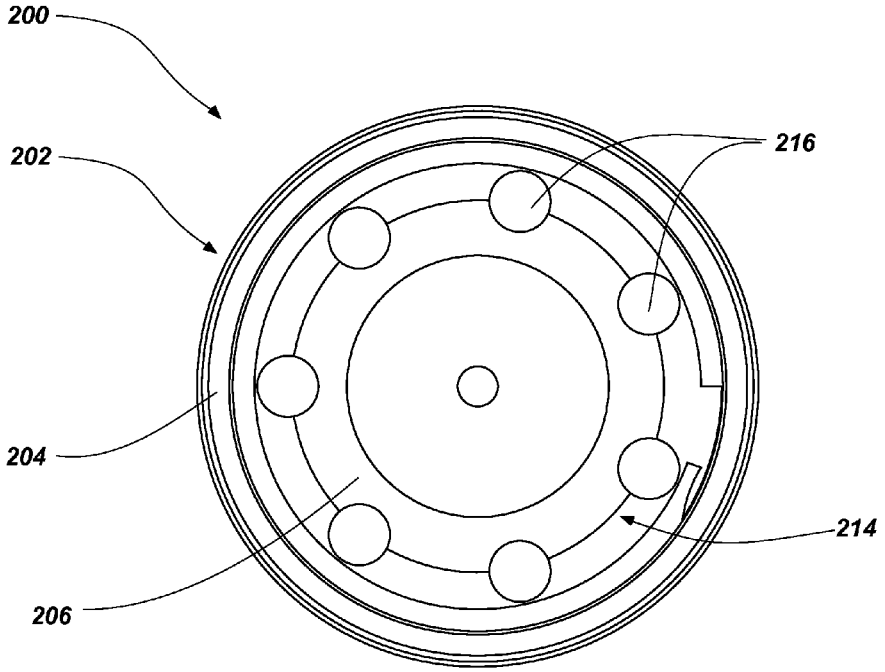
FIG. 5 is a side view of the gas generator shown in FIG. 4.

FIG. 4 is a perspective view of another embodiment of a gas generator 200 and FIG. 5 is a side view of the gas generator 200. As shown in FIGS. 4 and 5, the gas generator 200 may be substantially similar to and include the various components and features of the gas generator 100 discussed above with reference to FIGS. 1 through 3. For example, the gas generator 200 includes a housing 202 comprising an outer housing 204 and an inner housing 206 and an exit portion 214 including one or more apertures 216 extending through a portion of the housing 202 (e.g., the inner housing 206) for directing gases from the interior of the housing 202 to the exterior environment.

Figure 6:
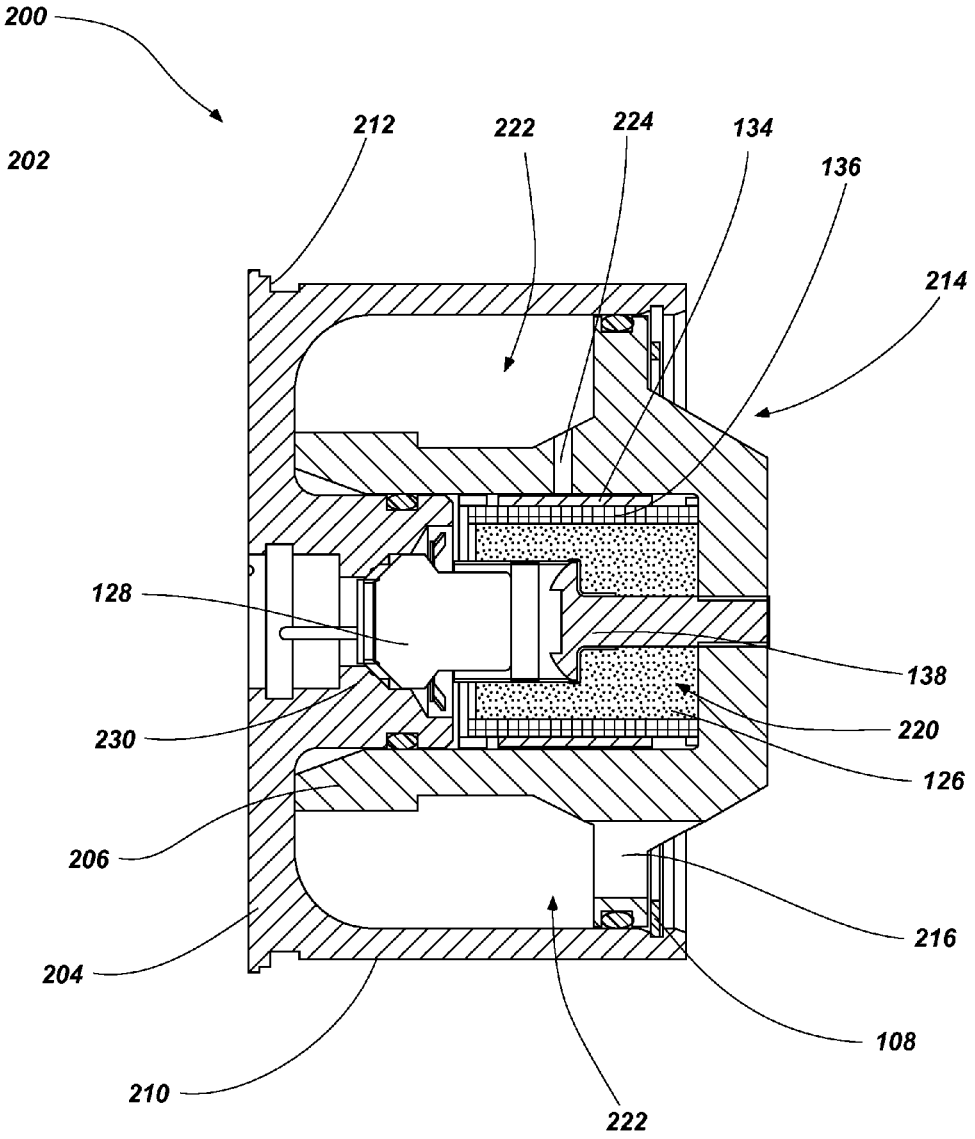
FIG. 6 is a partial cross-sectional view of the gas generator shown in FIG. 4.

FIG. 6 is a partial cross-sectional view of the gas generator 200 shown in FIG. 4. As shown in FIG. 6, the initiator 128 and propellant 126 are positioned and secured within the first plenum 220, which lies within the inner housing 206. The outer housing 204 may include an integral portion configured as an initiator holder portion 230. The initiator holder portion 230 of the outer housing 204 may be positioned and secured within the first plenum 220 formed within the inner housing 206 (e.g., with one or more O-rings at one or more interfaces between the outer and inner housings 204, 206). The initiator holder portion 230 of the outer housing 204 may seal (e.g., hermetically seal) at least a portion of the initiator 128 and the propellant 126 within the first plenum 220. The outer housing 204 (and the initiator holder portion 230 received within the inner housing 206) may be secured to the inner housing by snap ring 108.

Figure 7:
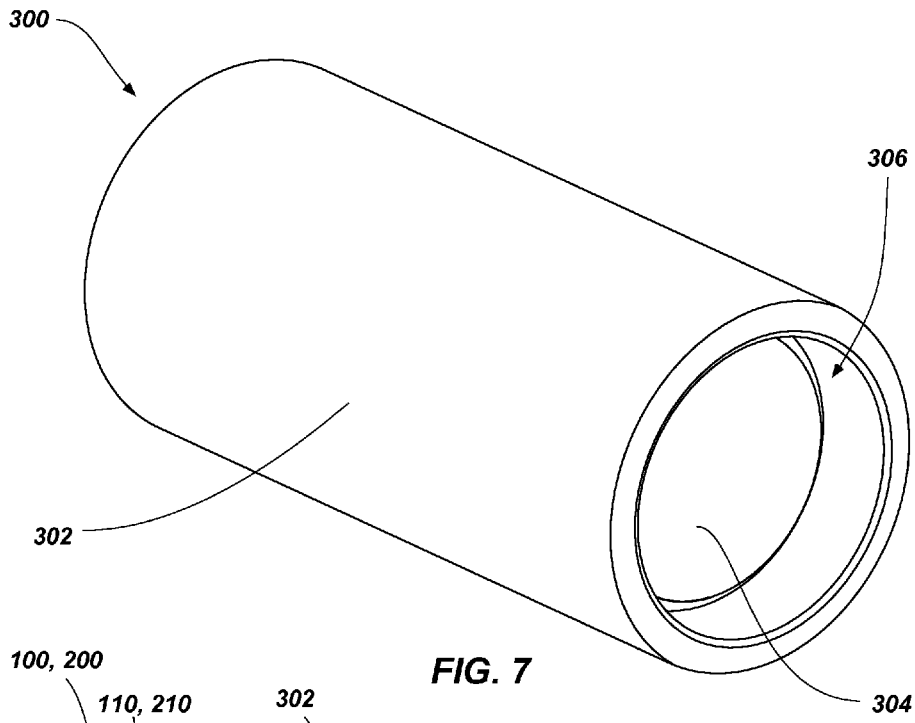
FIG. 7 is a perspective view of a launch tube assembly including a gas generator in accordance with yet another embodiment of the present disclosure.

FIG. 7 is a perspective view of a launch tube assembly 300 having a gas generator positioned therein (e.g., gas generators 100, 200 discussed above with reference to FIGS. 1 through 6). As shown in FIG. 7, the launch tube assembly 300 includes a launch tube 302 (e.g., a cylindrical launch tube) having a longitudinal axis $L_{302}$ (e.g., centerline) and a launch component 304 that may be disposed in the launch tube 302. In some embodiments, the launch component 304 may comprise one or more projectiles (e.g., a self-propelled projectile, a flare, etc.) that are to be launched from an open end 306 of the launch tube 302. For example, the projectile may include one or more integral elements for protecting it from the propulsive jets produced by the gas generator 100, 200 (e.g., a heat shield) or the projectile (e.g., a flare) may be intended to have a portion thereof ignited by the propulsive jets produced by the gas generator 100, 200. In some embodiments, the self-propelled projectile may comprise an unmanned aerial vehicle (UAV) (i.e., a drone), such as, for example, a SWITCHBLADE® aircraft manufactured by AeroVironment of Monrovia, Calif. In other embodiments, the launch component 304 may comprise a piston (e.g., a ram or pusher plate) configured to be positioned between the projectile and the gas generator 100, 200 in order to at least partially isolate the projectile from the propulsive jets produced by the gas generator 100, 200 while still imparting the thrust generated by the gas generator 100, 200 to the projectile. In yet other embodiments, the launch component 304 may comprise a piston and a projectile.

Figure 8:
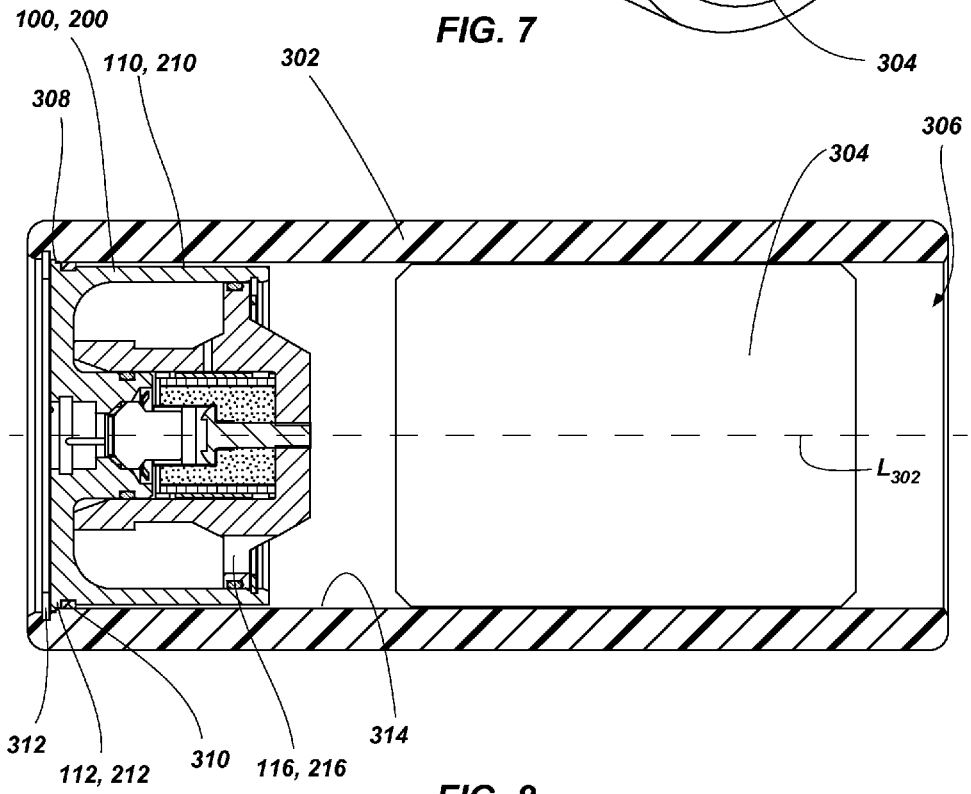
FIG. 8 is a partial cross-sectional view of the launch tube assembly shown in FIG. 7.

FIG. 8 is a partial cross-sectional view of the launch tube assembly 300 shown in FIG. 7. As shown in FIG. 8, the housing 102, 202 (FIGS. 1 through 6) of the gas generator 100, 200 may be formed to have a substantially cylindrical shape including a cylindrical outer surface 110, 210 in order to fit within a launch tube 302. For example, the housing 102 may be formed to fit within the launch tube 302, which has a complementary cylindrical shape, such that the outer surface 110, 210 of the housing 102, 202 opposes the inner surface 314 of the launch tube 302. The gas generator 100, 200 may be positioned within the launch tube 302 such that the propulsive jets, which extend through apertures 116, 216, are directed toward the open end 306 of the launch tube 302 (e.g., along the longitudinal axis $L_{302}$ of the launch tube 302).

The gas generator 100, 200 may further include a retaining feature 112, 212 for securing the gas generator 100, 200 within the launch tube 302. For example, the retaining feature 112, 212 may include a flange configured to engage with a complementary groove 308 formed at an end of the launch tube 302 opposing the open end 306. The retaining feature 112, 212 of the gas generator 100, 200 may be abutted against the groove 308 in the launch tube 302 and the gas generator 100, 200 may be secured and sealed within the launch tube 302, for example, with an O-ring 310 and a snap ring 312. Such a configuration may act to seal a portion of the gas generator 100, 200 (e.g., cylindrical outer surface 110 (FIG. 1)) against the inner wall 314 of the launch tube 302 to at least partially prevent gases formed by the gas generator 100, 200 from traveling around the gas generator 100, 200 to a back portion of the gas generator 100, 200 at the end of end of the launch tube 302 opposing the open end 306.

In operation, a gas generator (e.g., gas generators 100, 200) may be utilized to supply an initial velocity to a projectile launched (i.e., a cold launch) from a launch tube (e.g., launch tube 302). For example, propellant in the gas generator positioned within the launch tube may be ignited by an initiator. Ignition and subsequent combustion of the propellant may produce an exothermic reaction creating gases that fill the first plenum of the gas generator. As the gases are produced, the first plenum may become pressurized (e.g., to about 4000 psi to 15000 psi (about 27.58 MPa to 103.42 MPa)).

In embodiments where the burst foil 136 is implemented, which initially covers apertures leading from the first plenum 120, 220 to the second plenum 122, 222, the burst foil 136 may fail under the force applied thereto by the pressurized gas within first plenum 120, 220. In other embodiments, the gas pressure building in the first plenum 120, 220 may act upon initiation of the propellant 126 to continually force gases through the apertures 124, 224 into the second plenum 120, 220.

The propellant gases will travel from the first plenum 120, 220 through the apertures 124, 224 to the second plenum 122, 222 (e.g., in a direction transverse to the longitudinal axis of the housing of the gas generator 100, 200). For example, the gases may travel outwardly (e.g., radially outward) from the center portion of the gas generator 100, 200 to a radially outer portion of the gas generator 100, 200.

The second plenum 122, 222 may act as an expansion chamber causing the pressure and temperature of the gases to drop as the gases enter the second plenum 122, 222 from the first plenum 120, 220 via the apertures 124, 224. For example, the pressure of the gases may drop to about 400 to 1500 psi (about 2.76 MPa to 10.34 MPa) after entering the second plenum 122, 222.

The gases may then be directed out the gas generator in a selected direction (e.g., along the longitudinal axis of the housing 102, 202) to form propulsive jets that apply a force (e.g., thrust) to the projectile (e.g., directly or via a piston) to impart an initial velocity to the projectile. For example, the gases may travel along the length of housing 102, 202 (e.g., axially) to exit the gas generator 100, 200 through the apertures 116, 216. In other words, the second plenum 122, 222 may act to redirect the gases such that the gases exit the second plenum 122, 222 in a direction of travel different from the direction of travel that the gases entered the second plenum 122, 222. For example, the direction that the gases pass through the first apertures 124, 224 may be offset (e.g., about 90 degrees) from the direction that the gases pass through the second apertures.

In view of the above, embodiments of the present disclosure may be particularly useful in providing gas generators of a relatively straightforward and reliable design for generating gas and directing the gas from within the gas generator to surrounding environments (e.g., in the form of a propulsive jet). Such a design may minimize costs associated with the components of the gas generator and the overall size and weight of the gas generator. For example, some embodiments of the gas generations disclosed herein may enable the use of widely available (e.g., commercial off-the-shelf (COTS)) ignition and fuel components. Further, some embodiments of the gas generators disclosed herein, which are configured to direct the jets generated by the combustion of the propellant within the gas generator in a direction along the length of the launch tube, may also reduce damage to a launch tube caused by the jets (e.g., as compared to a gas generator that directs the jets in a lateral direction toward to the sidewalls of the launch tube).

While the gas generators have been described herein with general reference to use with launch tubes for projectile, it is noted that the gas generators may be utilized in other applications such as, for example, applications where gas generators are utilized as inflator devices or in any suitable applications where relatively large volumes of gas are utilized, but storing such gas in a pressurized state is undesirable or impractical.

While the present disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure includes all modifications, equivalents, legal equivalents, and alternatives falling within the scope of the disclosure as defined by the following appended claims.

What is claimed is:

1. A method of launching a projectile, the method comprising:

positioning a gas generator within a launch tube;

placing the projectile in the launch tube proximate the gas generator;

igniting a propellant with an initiator disposed in a first plenum of a housing of the gas generator;

combusting at least a portion of the propellant to form a gas;

flowing the gas through a first plurality of apertures formed in the housing surrounding the first plenum in a first direction to a second plenum at least partially laterally surrounding the first plenum and the first plurality of apertures;

flowing the gas through a second plurality of apertures formed in the housing in a second direction that is transverse to the first direction to form a plurality of propulsive jets exiting from the housing;

imparting an initial velocity to the projectile responsive to contact thereof by the plurality of propulsive jets exiting from the housing; and launching the projectile from the launch tube with the plurality of propulsive jets produced by the gas generator.

2. The method of claim 1, further comprising retaining the gas in the first plenum with a burst foil until the gas reaches a predetermined pressure within the first plenum.

3. The method of claim 1, further comprising introducing the gas directly into the second plurality of apertures from the second plenum, wherein the second plenum is positioned radially outward from the first plenum.

4. The method of claim 1, further comprising forming the plurality of propulsive jets in a ring extending about a longitudinal axis of the housing of the gas generator at an exit portion of the gas generator.

5. The method of claim 1, further comprising dissipating a shockwave formed by actuation of the initiator with a shock attenuation device positioned within the propellant.

6. The method of claim 1, further comprising enabling gas within the second plenum of the gas generator to freely exit the gas generator via the second plurality of apertures as the plurality of propulsive jets to impart the initial velocity to the projectile.

7. The method of claim 1, further comprising forming the plurality of propulsive jets exiting the gas generator through the second plurality of apertures in a direction substantially parallel to a longitudinal axis of the housing of the gas generator to impart the initial velocity to the projectile.

8. The method of claim 1, wherein flowing the gas through the first plurality of apertures formed in the housing surrounding the first plenum in a first direction to the second plenum comprises flowing the gas through the first plurality of apertures to the second plenum, wherein the second plenum is substantially free of a combustible gas generating material immediately prior to ignition of the propellant in the gas generator.

9. The method of claim 1, wherein imparting an initial velocity to the projectile comprises imparting the initial velocity to the projectile comprising a self-propelled projectile having an integrated propulsion system.

10. The method of claim 1, further comprising:

positioning a piston between the projectile and the gas generator to at least partially isolate the projectile from the plurality of propulsive jets produced by the gas generator; and imparting the initial velocity to the projectile by applying thrust to the piston with the plurality of propulsive jets produced by the gas generator.

11. A method of launching a projectile, the method comprising:

positioning a gas generator separate from the projectile within a launch tube;

placing the projectile in the launch tube in a position proximate the separate gas generator;

igniting the gas generator to form a gas in a first plenum of the gas generator;

flowing the gas through a first plurality of apertures surrounding the first plenum in a first direction to a second plenum;

reorienting flow of the gas from the first direction to a second direction that is transverse to the first direction and directed toward the projectile in the launch tube;

flowing the gas through a second plurality of apertures in the second direction to form a plurality of propulsive jets exiting from the gas generator in a direction toward the projectile; and launching the projectile from the launch tube with the plurality of propulsive jets produced by the gas generator.

12. The method of claim 11, further comprising positioning the gas generator in the launch tube to orient flow of the gas in the first direction to be transverse to a longitudinal axis of the launch tube and to orient flow of the gas in the second direction to be substantially parallel to the longitudinal axis of the launch tube.

13. The method of claim 11, further comprising, after launching the projectile from the launch tube, increasing a velocity of the projectile with a propellant system of the projectile separate from the gas generator.

14. The method of claim 11, further comprising sealing a portion of the gas generator within the launch tube at a closed end of the launch tube opposing an open end of the launch tube through which the projectile is launched.

15. The method of claim 11, further comprising directing the gas through the first plurality of apertures to the second plenum to reduce at least one of a temperature and a pressure of the gas, wherein the second plenum is substantially free of a combustible gas generating material immediately prior to ignition of the gas generator.

16. A method of launching a projectile, the method comprising:

igniting at least one propellant positioned within a first plenum defined in a central portion of a gas generator positioned in a launch tube with an initiator positioned proximate to the at least one propellant;

flowing gas from the first plenum into a second plenum substantially surrounding the at least one propellant through a plurality of apertures;

flowing the gas out of the second plenum through a second plurality of apertures into a chamber containing the projectile; and forming a plurality of propulsive jets with the gas generator exiting the gas generator through the second plurality of apertures in a direction substantially parallel to a longitudinal axis of the launch tube to impart an initial velocity to a projectile positioned within the launch tube.

* * * * *